US010471513B2

(12) United States Patent
Zhang et al.

(10) Patent No.: US 10,471,513 B2
(45) Date of Patent: Nov. 12, 2019

(54) METHOD FOR PREPARING NANO-COPPER POWDER

(71) Applicant: Institute of Chemistry, Chinese Academy of Sciences, Beijing (CN)

(72) Inventors: Xingye Zhang, Beijing (CN); Yanlin Song, Beijing (CN)

(73) Assignee: Institute of Chemistry, Chinese Academy of Sciences, Beijing (CN)

( * ) Notice: Subject to any disclaimer, the term of this patent is extended or adjusted under 35 U.S.C. 154(b) by 311 days.

(21) Appl. No.: 14/983,705

(22) Filed: Dec. 30, 2015

(65) Prior Publication Data

US 2016/0184900 A1 Jun. 30, 2016

(30) Foreign Application Priority Data

Dec. 31, 2014 (CN) ..... 2014 1 0855163

(51) Int. Cl.
*B22F 9/24* (2006.01)
*B22F 1/00* (2006.01)

(52) U.S. Cl.
CPC ..... *B22F 9/24* (2013.01); *B22F 1/0018* (2013.01); *B22F 1/0044* (2013.01); (Continued)

(58) Field of Classification Search
CPC .... B22F 2009/245; B22F 1/0018; B22F 9/24; B22F 2001/0092
See application file for complete search history.

(56) References Cited

U.S. PATENT DOCUMENTS 5,026,885 A * 6/1991 Bell ..... C07F 11/00 556/136
6,521,016 B2 * 2/2003 Kim ..... B22F 9/22 423/115

(Continued)

FOREIGN PATENT DOCUMENTS

CN 101386723 A 3/2009
CN 103056383 A 4/2013

(Continued)

OTHER PUBLICATIONS

Koroleva et al., "Synthesis of Copper Nanoparticles Stabilized by Polyoxyethylenesorbitan Monooleate," Russian Journal of Inorganic Chemistry, 2011, vol. 56, No. 1, pp. 6-10.

*Primary Examiner* — Colleen P Dunn
*Assistant Examiner* — Jeremy C Jones
(74) *Attorney, Agent, or Firm* — Volpe and Koenig, P.C.

(57) ABSTRACT

The present invention discloses a method for preparing nano-copper powder, comprising: (1) providing a dispersion solution, containing copper salt precursor and disperser, the disperser is dissoluble in both water and weak solvents, and is an acrylic modified polyurethane disperser; (2) providing a reducer dispersion solution, containing reducer, the reducer is organic borane; (3) contacting the reducer dispersion solution with the dispersion solution in a condition enough to reduce the copper salt precursor by the reducer into elementary copper; (4) separating copper nano-particles from reaction solution obtained by step (3), and drying separated copper nano-particles by spray drying, so as to obtain the nano-copper powder. The nano-copper powder prepared by the method in accordance with the present invention is dispersible in both water and environment-friendly weak solvents, which can be used to prepare weak solvent-type electrically conductive ink.

7 Claims, 1 Drawing Sheet

(52) U.S. Cl.
CPC . *B22F 2001/0092* (2013.01); *B22F 2009/245* (2013.01); *B22F 2301/10* (2013.01); *B22F 2304/05* (2013.01); *B22F 2999/00* (2013.01)

(56) References Cited

U.S. PATENT DOCUMENTS

| | | | | |
|---|---|---|---|---|
| 7,270,694 | B2 * | 9/2007 | Li | B22F 1/0018 75/351 |
| 2008/0138643 | A1 * | 6/2008 | Lee | B22F 1/0018 428/570 |
| 2009/0283726 | A1 * | 11/2009 | Mizoguchi | A61K 8/30 252/582 |
| 2010/0275729 | A1 * | 11/2010 | Jun | B22F 1/0025 75/364 |
| 2010/0314008 | A1 * | 12/2010 | Epshteyn | B22F 9/007 148/513 |
| 2012/0037041 | A1 * | 2/2012 | Nolte | B22F 1/0062 106/287.18 |
| 2012/0283336 | A1 * | 11/2012 | Grigorenko | B22F 1/0022 514/769 |
| 2013/0034650 | A1 * | 2/2013 | Li | A01N 25/28 426/650 |
| 2014/0033870 | A1 | 2/2014 | Tsay et al. | |

FOREIGN PATENT DOCUMENTS

| | | | | |
|---|---|---|---|---|
| CN | 103231071 | A | 8/2013 | |
| CN | 103341633 | A | 10/2013 | |
| CN | 103464774 | A | 12/2013 | |
| CN | 104028778 | A * | 9/2014 | |
| EP | 1593700 | A1 * | 11/2005 | B01F 17/0042 |
| WO | WO-2009040479 | A1 * | 4/2009 | B22F 1/0018 |

* cited by examiner

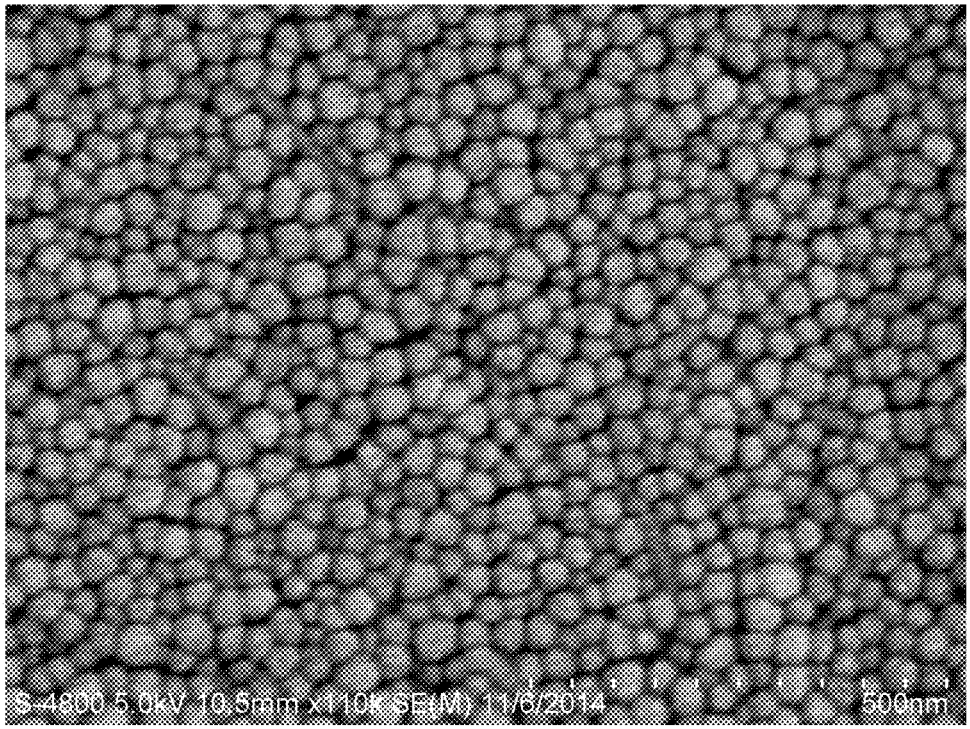
S-4800 5.0kV 10.5mm x110K SE(M) 11/6/2014
500nm

METHOD FOR PREPARING NANO-COPPER POWDER

CROSS REFERENCE TO RELATED APPLICATIONS

This application claims priority to Chinese Patent Application No. 201410855163.8, which was filed on Dec. 31, 2014, and is incorporated herein by reference as if fully set forth.

FIELD OF THE INVENTION

The present invention belongs to the technical field of preparation of metal nano-materials, in particular, the present invention relates to a method for preparing nano-copper through a solution phase reduction process.

BACKGROUND OF THE INVENTION

Nano-copper powder has advantages including small dimensions, large specific surface area, low resistance, quantum size effect, macroscopic quantum tunneling effect, etc., and has a very important application value in the field of metallic electrically conductive ink. Copper is lower in price when compared with silver, and can greatly reduce the cost. Especially, the research on preparation and application of copper powder, which is a potential substitute for precious metal powder, has received wide attention in the world.

Nano-copper preparation methods include physical methods and chemical methods. Physical methods include mechanical milling method and gamma ray method. Chemical methods include solution phase reduction method, micro-emulsion method, solvothermal method, vapor deposition method, electrolytic method, and plasma method, etc. The existing method for preparing nano-copper through a solution phase reduction process requires high temperature for reaction and demanding experiment conditions. CN101386723B discloses a method, which employs sodium hypophosphite as the reducer, cupric sulfate as the precursor, LD and PVP as the disperser, and diethylene glycol (DEG) as the organic phase to prepare nano-copper with a particle diameter of 20 nm to 50 nm at a temperature of 120° C. to 160° C. However, the nano-copper powder obtained with that method shows uneven particle diameter; moreover, the method has a low yield ratio, and requires a high temperature in the presence of organic solvent for protection.

A method that utilizes metal borohydride as the reducer and obtains nano-copper by reducing copper salt from strong alkaline solution with a pH value of higher than 12 at a temperature of 90° C. to 160° C. has been widely reported in the world. M. Yu. Koroleva, D. A. Kovalenko, V. M. Shkinev et at (Russian Journal of Inorganic Chemistry, 2011, 56(1): 6-10) prepared spherical copper nano-particles with a particle diameter of 25 nm to 35 nm by reducing the water solution of $Cu(NO_3)_2$ with $NaBH_4$ in the presence of polyoxyethylene sorbitan monooleate as disperser. However, when that method is used to prepare nano-copper, the reaction is vehement and the reaction system is unstable; in addition, the obtained copper powder product tends to agglomerate.

At present, nano-copper electrically conductive ink products existing in the market are only dispersible in water or alkanes (e.g., n-hexane, tetradecane, etc.); therefore, only water-based electrically conductive ink products or solvent-type electrically conductive ink products can be obtained. Since the principal component in water-based electrically conductive ink is water, leading to a low volatilization rate, and thus, circuits printed by water-based electrically conductive ink are not easy to dry. Consequently, the medium as support should have special coating; electronic circuits prepared with water-based electrically conductive ink show poor weather resistance, and it is difficult to maintain long-term performance stability of such electronic circuits in humid environments. The worst drawback of solvent-type electrically conductive ink is severe environmental pollution, since the volatile organic content in the ink is very high. In consideration of environmental protection, the application of solvent-type electrically conductive ink will be restricted gradually.

Hence, it is of great significance to provide nano-copper powder that is dispersible in water and environment-friendly weak solvents for the development of weak solvent-type electrically conductive ink.

SUMMARY OF THE INVENTION

The present application intends to solve the technical problem in the prior art that it is difficult to prepare weak solvent-type electrically conductive ink from nano-copper powder since the nano-copper powder is only dispersible in water or alkanes. The present invention provides a method for preparing nano-copper powder that is dispersible in both water and environment-friendly weak solvents, and thus can be used to produce weak solvent-type electrically conductive ink that is more environment friendly.

In accordance with a first aspect of the present invention, a method for preparing nano-copper powder is provided, comprising:

(1) providing a dispersion solution, the dispersion solution contains at least one copper salt precursor and at least one disperser, the disperser is dissoluble in both water and weak solvents;

(2) providing a reducer dispersion solution, the reducer dispersion solution contains at least one reducer;

(3) contacting the reducer dispersion solution with the dispersion solution provided by step (1) in a condition enough to reduce the copper salt precursor by the reducer into elementary copper;

(4) separating copper nano-particles from the reaction solution obtained by step (3), and drying separated copper nano-particles by spray drying, so as to obtain the nano-copper powder.

In accordance with a second aspect of the present invention, nano-copper powder prepared by the method described in the first aspect of the present invention is provided.

The nano-copper powder prepared by the method in accordance with the present invention has high dispersion compatibility, and is dispersible in water and environment-friendly weak solvents such as ethylene glycol monoethyl ether acetate and propylene glycol monomethyl ether acetate, etc. Therefore, the nano-copper powder prepared by the method in accordance with the present invention can be used to prepare weak solvent-type electrically conductive ink and overcome the drawbacks of poor weather resisting property of water-based electrically conductive ink and severe environmental pollution of solvent-type electrically conductive ink.

BRIEF DESCRIPTION OF THE DRAWINGS

FIG. 1 is a scanning electronic micrograph (SEM) image of the nano-copper powder prepared by Example 1 of the present invention performed on Hitachi-S4800.

DETAILED DESCRIPTION OF THE EMBODIMENTS

The method for preparing nano-copper powder in accordance with the present invention comprises:

(1) providing a dispersion solution, the dispersion solution contains at least one copper salt precursor and at least one disperser, the disperser is dissoluble in both water and weak solvents;

(2) providing a reducer dispersion solution, the reducer dispersion solution contains at least one reducer;

(3) contacting the reducer dispersion solution with the dispersion solution provided by step (1) in a condition enough to reduce the copper salt precursor by the reducer into elementary copper;

(4) separating copper nano-particles from reaction solution obtained by step (3), and drying separated copper nano-particles by spray drying, so as to obtain the nano-copper powder.

The copper salt precursor may be one or more selected from the group consisting of cupric chloride, cuprous chloride, cupric nitrate, cupric acetate, cuprous acetate, cupric subcarbonate, cupric sulfate, cupric lactate, cupric oleate, cupric laurate, cupric glycinate, cupric citrate, cupric tartrate, cupric malate, and octadecenoic acid copper salt. Preferably, the copper salt precursor is one or more selected from the group consisting of cupric chloride, cupric nitrate, cupric subcarbonate, cupric sulfate, and cupric lactate.

The disperser is dissoluble in both water and weak solvents, and is preferably an acrylic modified polyurethane disperser. Specifically, the disperser may be one or more selected from the group consisting of DISPERSER HLD-8 from SILCONA (Germany), DISPERSER W-S90 from PARTNER, DISPERSER EL-W604 from EONLEO, DISPERSER 904 from DEUCHEM, DISPERSERS B-180, B-4500, and B-4509 from BYK, and DISPERSERS 12B, 10S, and 12W-A from SHANGHAI SANZHENG (China).

The content of the disperser may be dependent on the content of the copper salt precursor. Based on 100 parts by weight of the copper salt precursor, the disperser may be in a content of 50 to 200 parts by weight, preferably in a content of 100 parts to 200 parts by weight, and more preferably in a content of 100 parts to 170 parts by weight.

The reducer is used to reduce the copper salt precursor into elementary copper. For example, the reducer may be inorganic borane, such as sodium borohydride.

In accordance with the method of the present invention, the reducer is preferably organic borane. In the case that the organic borane is employed as the reducer, the copper salt precursor can be reduced into elementary copper under mild conditions, and thereby ensures a stable reaction process and can effectively mitigate the trend of agglomeration of the generated copper powder. In addition, organic borane is resistant to oxidation and hydrolysis, and has stable properties; thus, waste of the reducer can be reduced. By using the organic borane as the reducer, the conversion ratio of the copper salt precursor can be 70% or higher, and the obtained nano-copper has even particle diameter; thus, the stability of product quality can be increased.

The examples of the organic borane may include but is not limited to one or more selected from the group consisting of diborane, tetraborane, pentaborane, decaborane, carborane, borane nitride, phosphine borane, borane sulfide, borane oxide, dimethylamine borane, triethylamine borane, triethyl borane, diethylmethoxy borane, triphenyl borane, 2-methylpyridine borane (2-PB), diisopinocampheyl chloroborane (such as (−)-diisopinocampheyl chloroborane and (+)-diisopinocampheyl chloroborane), morpholine borane, pyridine borane, borane-tetrahydrofuran complex, borane-dimethyl sulfide complex, o-carborane, m-carborane, N,N-diethylaniline borane, diethyl-(3-pyridyl) borane, catecholborane, pinacolborane, tert-butylamine borane, (R)-2-methyl-CBS-oxazaborolidine, 2-methylpyridine borane, and (S)-2-methyl-CBS-oxazaborolidine. Preferably, the organic borane is one or more selected from the group consisting of dimethylamine borane, triethyl borane, pyridine borane, tert-butylamine borane, and pinacolborane.

The content of the reducer may be dependent on the content of the copper salt precursor, as long as the content of the reducer is enough to reduce the copper salt precursor into elementary copper. Based on 100 parts by weight of the copper salt precursor, the reducer may be in a content of 50 parts to 600 parts by weight, preferably in a content of 100 parts to 500 parts by weight, and more preferably in a content of 150 parts to 400 parts by weight.

The dispersion medium in the dispersion solution in step (1) and the dispersion medium in the reducer dispersion solution in step (2) may be the same or different from each other, and may be respectively one or more selected from the group consisting of deionized water, ethanol, propanol, glycerol, isopropanol, ethylene glycol monomethyl ether, ethyl acetate, ethylene glycol butyl ether acetate, and propylene glycol ethyl ether acetate. Preferably, the dispersion medium in the dispersion solution in step (1) is the same as the dispersion medium in the reducer dispersion solution in step (2).

There is no particular restriction on the content of the dispersion medium in the dispersion solution in step (1), as long as the copper salt precursor and the disperser may be dispersed homogeneously. Generally, based on 100 parts of the copper salt precursor, the dispersion medium may be in a content of 200 parts to 6,000 parts by weight, and preferably in a content of 1,500 parts to 4,000 parts by weight.

The content of the dispersion medium in the reducer dispersion solution in step (2) may be determined in accordance with the content of the reducer. Generally, based on 100 parts by weight of the reducer, the content of the dispersion medium in the reducer dispersion solution may be in a content of 100 parts to 3,000 parts by weight, and preferably in a content of 500 parts to 1,000 parts by weight.

In step (3), the reducer dispersion solution contacts with the dispersion solution provided by step (1) in a condition enough to reduce the copper salt precursor in the dispersion solution into elementary copper, and the contact may be performed under routine conditions. The duration period of the contact may be selected in accordance with the contact conditions, and there is no particular restriction.

In accordance with the method of the present invention, in the case that the reducer is the organic borane, the copper salt precursor can be reduced into elementary copper even if the reducer dispersion solution contacts with the dispersion solution provided by step (1) under mild conditions; hence, the reaction can proceed stably, and agglomeration of the prepared elementary copper can be avoided.

In a preferred embodiment of the present invention, the reducer is the organic borane, and the reducer dispersion solution may contact with the dispersion solution at a temperature of 20° C. to 60° C. In the preferred embodiment, the duration period of the contact may be in a range of 120 min to 600 min, and preferably in a range of 300 min to 500 min.

In step (4), the copper nano-particles may be separated from the reaction solution obtained in step (3) with a conventional method, and there is no particular restriction. For example, the copper nano-particles may be separated from the reaction solution obtained in step (3) by filtration, sedimentation, decantation or a combination of more than two thereof.

In a preferred embodiment, in step (4), the copper nano-particles are separated from the reaction solution obtained by step (3) through filtration. The filtering medium used in the filtration may be a common filtering medium, such as filter cloth, filter membrane, or a combination of thereof. Preferably, an ultrafiltration membrane is used as the filtering medium to separate copper nano-particles from the reaction solution obtained by step (3). The ultrafiltration membrane preferably has a pore diameter in a range of 10 kDa to 300 kDa, and more preferably has a pore diameter in a range of 10 kDa to 150 kDa. The ultrafiltration membrane may be ceramic ultrafiltration membrane or fiber ultrafiltration membrane.

In step (4), the separation operation may be executed once or more than twice, to decrease the liquid content in the separated copper nano-particles. Generally, the liquid content in the separated copper nano-particles may be in a range of not higher than 30 wt %, and preferably in a range of not higher than 15 wt %. The liquid content is calculated as the weight percentage of weight loss of the separated copper nano-particles by drying at a temperature of 150° C. for 5 h to the weight of the copper nano-particles to be dried.

In step (4), the separated copper nano-particles are dried by spray drying to obtain nano-copper powder. The spray drying may be a conventional spray drying method, such as pressure spray drying, centrifugal spray drying, air spray drying, or a combination of more than two thereof. Preferably, the spray drying is centrifugal spray drying. In centrifugal spray drying, the centrifugal force may be adjusted, so as to regulate the particle size of the nano-copper powder.

In step (4), upon spray drying, the inlet temperature may be in a range of 250° C. to 350° C., and preferably in a range of 280° C. to 350° C.; the outlet temperature may be in a range of 80° C. to 120° C., and preferably in a range of 100° C. to 120° C.

The nano-copper powder prepared by the method in accordance with the present invention may have a particle size in a range of 5 nm to 100 nm, and preferably in a range of 20 nm to 60 nm. The nano-copper powder prepared by the method in accordance with the present invention has a narrow particle size distribution. Generally, the nano-copper powder prepared by the method in accordance with the present invention may have a relative standard deviation for particle size not higher than 10 nm, preferably not higher than 8 nm, more preferably not higher than 5 nm. In the context of the present application, the particle size is measured by scanning electronic micrograph (SEM), specifically, at 30,000× magnification, determining the particle size (that is, maximum radial length) of all nano-silver powder particles appearing in the viewing field of the ocular lens, and calculating the average particle size as the particle size of the nano-silver powder.

The nano-copper powder prepared by the method in accordance with the present invention is dispersible in both water and weak solvents, as a result, weak solvent-type electrically conductive ink can be prepared. The examples of the weak solvent may include, but is not limited to one or more selected from the group consisting of ethylene glycol monobutyl ether acetate, propylene glycol monomethyl ether acetate, dipropylene glycol monomethyl ether acetate, dipropylene glycol monoethyl ether acetate, dipropylene glycol monobutyl ether acetate, propylene glycol monoethyl ether acetate, diethylene glycol monomethyl ether acetate, diethylene glycol monoethyl ether acetate, diethylene glycol monobutyl ether acetate, ethylene glycol phenyl ether acetate, propylene glycol phenyl ether acetate, diglycol monobutyl ether acetate, dipropylene glycol monomethyl ether, tripropylene glycol monomethyl ether, terpineol, triethylene glycol monomethyl ether, triethylene glycol monobutyl ether, diethylene glycol monomethyl ether, and diethylene glycol monobutyl ether.

In accordance with a second aspect of the present invention, a nano-copper powder prepared by the method described in the first aspect of the present invention is provided.

Hereinafter, the present invention will be described in detail in connection with examples, but these examples shall not be deemed as constituting any limitation to the scope of the present invention.

In the examples and comparative examples, the dispersity of the prepared nano-copper powder is determined in water and weak solvent respectively as the dispersion medium by the method described below. 5 g nano-copper powder is placed into a beaker containing 50 g dispersion medium, the mixture is stirred by mechanical stirring for 5 min at a stirring speed of 200 rpm, then the stirring is stopped, and the mixture is held in still for 5 min; the dispersion solution is observed to check whether there is delamination and/or whether there is any precipitate on the bottom of the beaker. It is deemed that the nano-copper powder has been dispersed in the dispersion medium if there is neither delamination nor precipitate. The dispersion medium used in the experiments is deionized water, ethylene glycol monobutyl ether acetate, dipropylene glycol monomethyl ether acetate, and diethylene glycol monobutyl ether respectively.

In the examples and comparative examples, the content of elementary copper in the prepared nano-copper powder is measured with a thermogravimetric analysis method. Specifically, the prepared nano-copper powder is tested with a Nestal TG209F1 thermogravimetric analyzer with test temperature range from 30° C. to 500° C. at a heating rate of 10° C./min in nitrogen atmosphere, and the residual mass at 500° C. is taken as the content of elementary copper.

EXAMPLE 1

(1) At room temperature (25° C.), 10 g cupric chloride and 10 g DISPERSER HLD-8from SILCONA (Germany) are added into 150 mL deionized water, and the mixture is stirred by magnetic stirring to disperse homogeneously; thus, a dispersion solution is obtained.

(2) 20 g dimethylamine borane as reducer is added into 200 mL deionized water, and the mixture is stirred by magnetic stirring to mix homogeneously; thus, a reducer dispersion solution is obtained.

(3) The reducer dispersion solution obtained by step (2) is added by dropwise into the dispersion solution obtained by step (1) with stirring, and then the obtained mixed solution is maintained at 20° C. to react for 360 min.

(4) The reaction solution obtained by step (3) is separated by cycling separation with an ultrafiltration membrane (wherein, the ultrafiltration membrane used is ceramic filter membrane with a pore diameter of 80 kDa), and the entrapped copper nano-particles with a liquid content of not higher than 15% by weight are dried by centrifugal spray drying (inlet temperature: 300° C., outlet temperature: 120° C.), so as to obtain nano-copper powder.

The content of elementary copper in the nano-copper powder is measured as 95.3% by weight. The conversion ratio of cupric chloride is calculated as 95%. In the prepared nano-copper powder, the copper nano-particles have a particle diameter of 40.0 nm±5.0 nm. The prepared nano-copper powder is respectively dispersible in deionized water, ethylene glycol monobutyl ether acetate, dipropylene glycol monomethyl ether acetate, and diethylene glycol monobutyl ether.

COMPARATIVE EXAMPLE 1

Nano-copper powder is prepared with the same method as that used in example 1, but the dispersion solution prepared in step (1) contains no disperser. Consequently, no nano-copper powder is prepared.

EXAMPLE 2

Nano-copper powder is prepared with the same method as that used in example 1, but sodium borohydride is used as the reducer.

(1) At room temperature (25° C.), 10 g cupric chloride and 10 g DISPERSER HLD-8 from SILCONA (Germany) are added into 150 mL deionized water, and the mixture is stirred by magnetic stirring to disperse homogeneously; thus, a dispersion solution is obtained.

(2) 20 g sodium borohydride as reducer is added into 200 mL deionized water, and the mixture is stirred by magnetic stirring to mix homogeneously; thus, a reducer dispersion solution is obtained.

(3) The reducer dispersion solution obtained by step (2) is added by dropwise into the dispersion solution obtained by step (1) with stirring, and then the obtained mixed solution is maintained at 20° C. to react for 360 min.

(4) The reaction solution obtained by step (3) is separated by cycling separation with an ultrafiltration membrane (wherein, the ultrafiltration membrane used is ceramic filter membrane with a pore diameter of 80 kDa), and the entrapped copper nano-particles with a liquid content of not higher than 15% by weight are dried by centrifugal spray drying (inlet temperature: 300° C., outlet temperature: 120° C.), so as to obtain nano-copper powder.

During the reaction process with sodium borohydride, a lot of bubbles are released, and the reaction is vehement. The prepare nano-copper has a wide particle size with uneven particle size distribution. The content of elementary copper in the nano-copper powder is measured as 38% by weight. The conversion ratio of cupric chloride is calculated as 40%. In the prepared nano-copper powder, the minimum particle diameter of the copper nano-particles is 30 nm, and the maximum particle diameter is 200 nm. The prepared nano-copper powder is dispersible in deionized water, ethylene glycol monobutyl ether acetate, dipropylene glycol monomethyl ether acetate, and diethylene glycol monobutyl ether.

EXAMPLE 3

(1) At room temperature (25° C.), 10 g cupric nitrate and 15 g DISPERSER W-S90 from PARTNER are added into 200 mL deionized water, and the mixture is stirred by magnetic stirring to disperse homogeneously; thus, a dispersion solution is obtained.

(2) 30 g triethyl borane as reducer is added into 200 mL deionized water, and the mixture is stirred by magnetic stirring to mix homogeneously; thus, a reducer dispersion solution is obtained.

(3) The reducer dispersion solution obtained by step (2) is added by dropwise into the dispersion solution obtained by step (1) with stirring, and then the obtained mixed solution is maintained at 60° C. to react for 300 min.

(4) The reaction solution obtained by step (3) is separated by cycling separation with an ultrafiltration membrane (wherein, the ultrafiltration membrane used is ceramic filter membrane with a pore diameter of 30 kDa), and the entrapped copper nano-particles with a liquid content of not higher than 15% by weight are dried by centrifugal spray drying (inlet temperature: 280° C., outlet temperature: 100° C.), so as to obtain nano-copper powder.

The content of elementary copper in the nano-copper powder is measured as 98.1% by weight. The conversion ratio of cupric nitrate is calculated as 100%. In the prepared nano-copper powder, the copper nano-particles have a particle diameter of 35.0 nm±5.0 nm. The prepared nano-copper powder is dispersible in deionized water, ethylene glycol monobutyl ether acetate, dipropylene glycol monomethyl ether acetate, and diethylene glycol monobutyl ether.

EXAMPLE 4

(1) At room temperature (25° C.), 8 g cupric subcarbonate and 13 g DISPERSER EL-W604 from EONLEO are added into 150 mL deionized water, and the mixture is stirred by magnetic stirring to disperse homogeneously; thus, a dispersion solution is obtained.

(2) 15 g pyridine borane as reducer is added into 150 mL deionized water, and the mixture is stirred by magnetic stirring to mix homogeneously; thus, a reducer dispersion solution is obtained.

(3) The reducer dispersion solution obtained by step (2) is added by dropwise into the dispersion solution obtained by step (1) with stirring, and then the obtained mixed solution is maintained at 50° C. to react for 400 min.

(4) The reaction solution obtained by step (3) is separated by cycling separation with an ultrafiltration membrane (wherein, the ultrafiltration membrane used is ceramic filter membrane with a pore diameter of 10 kDa), and the entrapped copper nano-particles with a liquid content of not higher than 15% by weight are dried by centrifugal spray drying (inlet temperature: 350° C., outlet temperature: 120° C.), so as to obtain nano-copper powder.

The content of elementary copper in the nano-copper powder is measured as 96.4% by weight. The conversion ratio of cupric subcarbonate is calculated as 85%. In the prepared nano-copper powder, the copper nano-particles have a particle diameter of 25.0 nm±5.0 nm. The prepared nano-copper powder is dispersible in deionized water, ethylene glycol monobutyl ether acetate, dipropylene glycol monomethyl ether acetate, and diethylene glycol monobutyl ether.

EXAMPLE 5

(1) At room temperature (25° C.), 9 g cupric sulfate and 14 g DISPERSER 904 from DEUCHEM are added into 350 mL deionized water, and the mixture is stirred by magnetic stirring to disperse homogeneously; thus, a dispersion solution is obtained.

(2) 35 g tertiary butylamine borane as reducer is added into 250 mL deionized water, and the mixture is stirred by magnetic stirring to mix homogeneously; thus, a reducer dispersion solution is obtained.

(3) The reducer dispersion solution obtained by step (2) is added by dropwise into the dispersion solution obtained by step (1) with stirring, and then the obtained mixed solution is maintained at 60° C. to react for 500 min.

(4) The reaction solution obtained by step (3) is separated by cycling separation with an ultrafiltration membrane (wherein, the ultrafiltration membrane used is ceramic filter membrane with a pore diameter of 100 kDa), and the entrapped copper nano-particles with a liquid content of not higher than 15% by weight are dried by centrifugal spray drying (inlet temperature: 300° C., outlet temperature: 100° C.), so as to obtain nano-copper powder.

The content of elementary copper in the nano-copper powder is measured as 97.5% by weight. The conversion ratio of cupric sulfate is calculated as 93%. In the prepared nano-copper powder, the copper nano-particles have a particle diameter of 50.0 nm±8.0 nm. The prepared nano-copper powder is dispersible in deionized water, ethylene glycol monobutyl ether acetate, dipropylene glycol monomethyl ether acetate, and diethylene glycol monobutyl ether.

EXAMPLE 6

(1) At room temperature (25° C.), 10 g cupric lactate and 10 g DISPERSER B-180 from BYK are 40 added into 220 mL deionized water, and the mixture is stirred by magnetic stirring to disperse homogeneously; thus, a dispersion solution is obtained.

(2) 28 g pinacolborane borane as reducer is added into 230 mL deionized water, and the mixture is stirred by magnetic stirring to mix homogeneously; thus, a reducer dispersion solution is obtained.

(3) The reducer dispersion solution obtained by step (2) is added by dropwise into the dispersion solution obtained by step (1) with stirring, and then the obtained mixed solution is maintained at 60° C. to react for 480 min.

(4) The reaction solution obtained by step (3) is separated by cycling separation with an ultrafiltration membrane (wherein, the ultrafiltration membrane used is ceramic filter membrane with a pore diameter of 150 kDa), and the entrapped copper nano-particles with a liquid content of not higher than 15% by weight are dried by centrifugal spray drying (inlet temperature: 320° C., outlet temperature: 110° C.), so as to obtain nano-copper powder.

The content of elementary copper in the nano-copper powder is measured as 98.3% by weight. The conversion ratio of cupric lactate is calculated as 72%. In the prepared nano-copper powder, the copper nano-particles have a particle diameter of 60.0 nm±5.0 nm. The prepared nano-copper powder is dispersible in deionized water, ethylene glycol monobutyl ether acetate, dipropylene glycol monomethyl ether acetate, and diethylene glycol monobutyl ether.

The invention claimed is:

1. A method for preparing nano-copper powder, comprising:

(1) providing a dispersion solution, the dispersion solution contains at least one copper salt precursor and at least one disperser, the disperser is dissoluble in both water and weak solvents, and is an acrylic modified polyurethane disperser;

(2) providing a reducer dispersion solution, the reducer dispersion solution contains at least one reducer, the reducer is organic borane, the organic borane is one or more selected from the group consisting of triethyl borane and pinacolborane;

(3) contacting the reducer dispersion solution with the dispersion solution provided by step (1) in a condition enough to reduce the copper salt precursor by the reducer into elementary copper;

(4) separating copper nano-particles from reaction solution obtained by step (3), and drying separated copper nano-particles by spray drying, so as to obtain the nano-copper powder;

wherein the dispersion medium in the dispersion solution in step (1) and the dispersion medium in the reducer dispersion solution in step (2) is deionized water.

2. The method in accordance with claim 1, wherein, based on 100 parts by weight of the copper salt precursor, the disperser is in a content of 50 to 200 parts by weight.

3. The method in accordance with claim 1, wherein the copper salt precursor is one or more selected from the group consisting of cupric chloride, cuprous chloride, cupric nitrate, cupric acetate, cuprous acetate, cupric subcarbonate, cupric sulfate, cupric lactate, cupric oleate, cupric laurate, cupric glycinate, cupric citrate, cupric tartrate, cupric malate, and octadecenoic acid copper salt.

4. The method in accordance with claim 1, wherein, based on 100 parts by weight of the copper salt precursor, the reducer is in a content of 50 parts to 600 parts by weight.

5. The method in accordance with claim 1, wherein, an ultrafiltration membrane is used as filtering medium to separate copper nano-particles from the reaction solution obtained by step (3).

6. The method in accordance with claim 5, wherein, the ultrafiltration membrane has a pore diameter in a range of 10 kDa to 300 kDa.

7. The method in accordance with claim 1, wherein, upon spray drying, inlet temperature is in a range of 250° C. to 350° C., outlet temperature is in a range of 80° C. to 120° C.

* * * * *